US007711486B2

(12) United States Patent
Thigpen et al.

(10) Patent No.: US 7,711,486 B2
(45) **Date of Patent: *May 4, 2010**

(54) SYSTEM AND METHOD FOR MONITORING PHYSICAL CONDITION OF PRODUCTION WELL EQUIPMENT AND CONTROLLING WELL PRODUCTION

(75) Inventors: Brian L. Thigpen, Houston, TX (US); Guy P. Vachon, Houston, TX (US); Garabed Yeriazarian, Katy, TX (US); Jaedong Lee, Katy, TX (US); Chee M. Chok, Houston, TX (US); Clark Sann, Houston, TX (US); Xin Liu, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 93 days.

This patent is subject to a terminal disclaimer.

(21) Appl. No.: 11/737,313

(22) Filed: Apr. 19, 2007

(65) Prior Publication Data

US 2008/0262736 A1 Oct. 23, 2008

(51) Int. Cl.
*G01V 1/40* (2006.01)
*G01V 3/18* (2006.01)
*G01V 5/04* (2006.01)

(52) U.S. Cl. ..... 702/9; 702/12

(58) Field of Classification Search ..... 702/6, 702/9, 12, 45, 50, 100, 182, 179, 181; 166/252.1, 166/369; 703/7, 9, 10, 13, 18
See application file for complete search history.

(56) References Cited

U.S. PATENT DOCUMENTS 3,211,225 A 10/1965 Thiessen et al.
3,710,867 A 1/1973 Bansbach
3,954,006 A 5/1976 Anderson et al. ..... 73/152.34
3,991,827 A 11/1976 Schall ..... 166/253.1

(Continued)

FOREIGN PATENT DOCUMENTS

GB 2416871 A 2/2006

(Continued)

OTHER PUBLICATIONS

Schlumberger, Well Test Interpretation, 2002, 126 pages.

(Continued)

*Primary Examiner*—Michael P Nghiem
(74) *Attorney, Agent, or Firm*—Madan & Sriram, P.C.

(57) ABSTRACT

A system and method for producing fluid from a completed well is provided wherein the method in one aspect includes determining a first setting of at least one first device under use for producing the fluid from the well; selecting a first set of input parameters that includes at least one parameter relating to health of at least one second device and a plurality of parameters selected from a group consisting of information relating to flow rate, pressure, temperature, presence of a selected chemical, water content, sand content, and chemical injection rate; and using the selected first set of parameters as an input to a computer model, determining a second setting for the at least one first device that will provide at least one of an increased life of at least one second device and enhanced flow rate for the fluid from the completed well.

14 Claims, 5 Drawing Sheets

U.S. PATENT DOCUMENTS

| | | | | |
|---|---|---|---|---|
| 4,064,936 | A | 12/1977 | McClure | |
| 4,284,143 | A | 8/1981 | Scherrer et al. | |
| 4,354,553 | A | 10/1982 | Hensley | |
| 4,375,833 | A | 3/1983 | Meadows | |
| 4,436,148 | A | 3/1984 | Maxwell | |
| 4,582,131 | A | 4/1986 | Plummer et al. | |
| 4,589,434 | A | 5/1986 | Kelley | |
| 4,635,723 | A | 1/1987 | Spivey | |
| 4,665,981 | A | 5/1987 | Hayatdavoudi | |
| 4,721,158 | A | 1/1988 | Merritt, Jr. et al. | |
| 4,830,112 | A | 5/1989 | Erickson | |
| 4,843,247 | A | 6/1989 | Yamazoe et al. | |
| 4,901,563 | A | 2/1990 | Pearson | |
| 4,926,942 | A | 5/1990 | Profrock, Jr. | |
| 5,006,845 | A | 4/1991 | Calcar et al. | 367/81 |
| 5,172,717 | A | 12/1992 | Boyle et al. | |
| 5,209,301 | A | 5/1993 | Ayres | |
| 5,305,209 | A | 4/1994 | Stein et al. | 702/13 |
| 5,353,237 | A | 10/1994 | Bass et al. | |
| 5,517,593 | A | 5/1996 | Nenniger et al. | |
| 5,647,435 | A | 7/1997 | Owens et al. | 166/250.01 |
| 5,706,896 | A | 1/1998 | Tubel et al. | |
| 5,767,680 | A | 6/1998 | Torres-Verdin et al. | 324/355 |
| 5,829,520 | A | 11/1998 | Johnson | |
| 5,937,946 | A | 8/1999 | Streetman | |
| 6,006,832 | A | 12/1999 | Tubel et al. | |
| 6,061,634 | A | 5/2000 | Belani et al. | 702/12 |
| 6,070,663 | A | 6/2000 | Cernocky et al. | 166/272.3 |
| 6,192,480 | B1 * | 2/2001 | Barrus | 713/320 |
| 6,196,314 | B1 | 3/2001 | Chen | |
| 6,281,489 | B1 | 8/2001 | Tubel et al. | |
| 6,467,340 | B1 | 10/2002 | Gallagher et al. | |
| 6,543,540 | B2 | 4/2003 | Woie et al. | 166/305.1 |
| 6,645,769 | B2 | 11/2003 | Tayebi et al. | 436/56 |
| 6,795,773 | B2 | 9/2004 | Soliman et al. | 702/6 |
| 6,851,444 | B1 | 2/2005 | Kohl et al. | |
| 6,874,361 | B1 | 4/2005 | Meltz et al. | 73/152.32 |
| 7,234,524 | B2 * | 6/2007 | Shaw et al. | 166/304 |
| 7,389,787 | B2 * | 6/2008 | Means et al. | 137/13 |
| 7,434,619 | B2 | 10/2008 | Rossi et al. | 166/250.15 |
| 7,484,563 | B2 | 2/2009 | Zazovsky et al. | 166/264 |
| 2002/0043370 | A1 | 4/2002 | Poe | 166/250.07 |
| 2002/0179301 | A1 | 12/2002 | Schultz et al. | 166/250.01 |
| 2003/0079912 | A1 | 5/2003 | Leuchtenberg | 175/38 |
| 2004/0084180 | A1 | 5/2004 | Shah et al. | 166/250.16 |
| 2004/0262008 | A1 | 12/2004 | Deans et al. | 166/339 |
| 2005/0149264 | A1 | 7/2005 | Tarvin et al. | 702/6 |
| 2005/0173114 | A1 | 8/2005 | Cudmore et al. | |
| 2007/0078610 | A1 | 4/2007 | Adams et al. | 702/28 |
| 2007/0139014 | A1 * | 6/2007 | Girson et al. | 320/132 |
| 2007/0289739 | A1 | 12/2007 | Cooper et al. | 166/250.01 |
| 2007/0289740 | A1 * | 12/2007 | Thigpen et al. | 166/250.01 |
| 2008/0152371 | A1 * | 6/2008 | Burry et al. | 399/50 |
| 2008/0201080 | A1 | 8/2008 | Lovell et al. | 702/12 |
| 2008/0257544 | A1 * | 10/2008 | Thigpen et al. | 166/250.01 |
| 2008/0262735 | A1 * | 10/2008 | Thigpen et al. | 702/6 |
| 2008/0262737 | A1 * | 10/2008 | Thigpen et al. | 702/9 |

FOREIGN PATENT DOCUMENTS

| | | | |
|---|---|---|---|
| WO | WO9857030 | | 12/1998 |
| WO | WO9957417 | | 11/1999 |
| WO | WO0000716 | | 1/2000 |
| WO | WO02063130 | A1 | 8/2002 |
| WO | WO2005045371 | A1 | 5/2005 |
| WO | 2006127939 | A2 | 11/2006 |

OTHER PUBLICATIONS

M.C.T. Kuo, "Correlations rapidly analzye water coning," Technology, Oct. 2, 1989, Oil and Gas Journal, pp. 77-80.

* cited by examiner

SYSTEM AND METHOD FOR MONITORING PHYSICAL CONDITION OF PRODUCTION WELL EQUIPMENT AND CONTROLLING WELL PRODUCTION

BACKGROUND OF THE DISCLOSURE

1. Field of the Disclosure

This disclosure relates generally to monitoring of production well equipment for enhanced production of hydrocarbons.

2. Background of the Art

Wellbores are drilled in subsurface formations for the production of hydrocarbons (oil and gas). A variety of wells are formed, including vertical wells, inclined wells, horizontal wells and multi-lateral wells. Some such wells penetrate multiple production zones and may traverse substantial distance in the subsurface formations. Wells are typically completed by cementing jointed metallic pipes (referred to as the casing) in the well, with the cement forming a bond between the formation and the casing that lines the well. Complex wells may include multiple remote control devices such as chokes, valve, artificial lift devices, such as an electrical submersible pump (ESP); a variety of sensors, such as pressure sensor, temperature and flow sensors; hydraulic lines that inject chemicals at various depths in the well or operate downhole devices; and electrical devices, circuits and processors that process data and signals downhole and establish communication with surface and other downhole equipment.

Downhole well conditions, such as high pressure differential between the formation and the well, high formation fluid flow rate and the condition of the formation rock, such as high permeability can cause excessive production of sand, cause formation of scale, corrosion, hydrate, paraffin and asphaltene, each of which can erode downhole equipment, block fluid flow paths in the downhole equipment and the tubing that carries the fluids to the surface, degrade performance of the ESP, etc. Cracks in the cement bond can allow undesirable fluids from adjoining formations to penetrate into the well. For efficient production of fluids from the formation to the surface, it is desirable to monitor the wellbore condition and the physical condition or health of various equipment, take actions that may provide enhanced or optimal production of hydrocarbons from the well.

SUMMARY OF THE DISCLOSURE

A method of producing fluid from a completed well is provided, which in one aspect includes: determining a first setting of at least one first device under use for producing the fluid from the well; selecting a first set of input parameters that includes at least one parameter relating to health of at least one second device and a plurality of parameters selected from a group consisting of information relating to flow rate, pressure, temperature, presence of a selected chemical, water content, sand content, and chemical injection rate; and using the selected first set of parameters as an input to a computer model, determining a second setting for the at least one first device that will provide at least one of an increased life of the at least one second device and enhanced flow rate for the fluid from the completed well.

In another aspect, the method controls the operation of an electrical submersible pump in a well that is producing fluids, wherein the method may include: determining an operating envelope for the electrical submersible pump that includes a maximum or optimal flow rate for the electrical submersible pump corresponding to the frequency and head over the electrical submersible pump; measuring an operating parameter of the electrical submersible using a sensor in the well; and altering an operation of the electrical submersible pump and/or another downhole device so as to operate the electrical submersible pump within the operating envelope or proximate the maximum flow rate.

In another aspect, a computer system for controlling an operation of an electrical submersible pump placed in a well for producing the fluid from the well is provided which may include: a database that stores information corresponding to one of: an operating envelope for the electrical submersible pump that is based on a relationship among fluid flow rate, frequency and head over the electrical submersible pump; and a maximum flow rate for the electrical submersible pump corresponding to the frequency and head; and a processor that utilizes at least one measured operating parameter of the electrical submersible pump and the information stored in the database and determines a setting for at least the electrical submersible pump and another downhole device that will cause the electrical submersible pump to operate according to one of: within the envelope; and proximate the maximum flow rate.

In another aspect a computer-readable-medium is provided that has embedded therein a computer program which is accessible to a processor for executing instructions contained in the computer program and wherein the computer program may include: instructions to determine a first setting of at least one first device while in use for producing the fluid from the well; instructions to select a first set of input parameters that includes at least one parameter relating to health of at least one second device and a plurality of parameters selected from a group consisting of information relating to flow rate, pressure, temperature, presence of a selected chemical, water content, sand content, and chemical injection rate; and instructions to use the selected first set of parameters as an input to determine a second setting for the at least one first device that will provide at least one of an increased life of the at least one second device and enhanced flow rate for the fluid from the completed well.

Examples of the more important features of a system and method for monitoring a physical condition of a production well equipment and controlling well production have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the system and methods for monitoring and controlling production wells described and claimed herein, reference should be made to the accompanying drawings and the following detailed description of the drawings wherein like elements generally have been given like numerals, and wherein:

DETAILED DESCRIPTION OF THE DRAWINGS

Figure 1A:
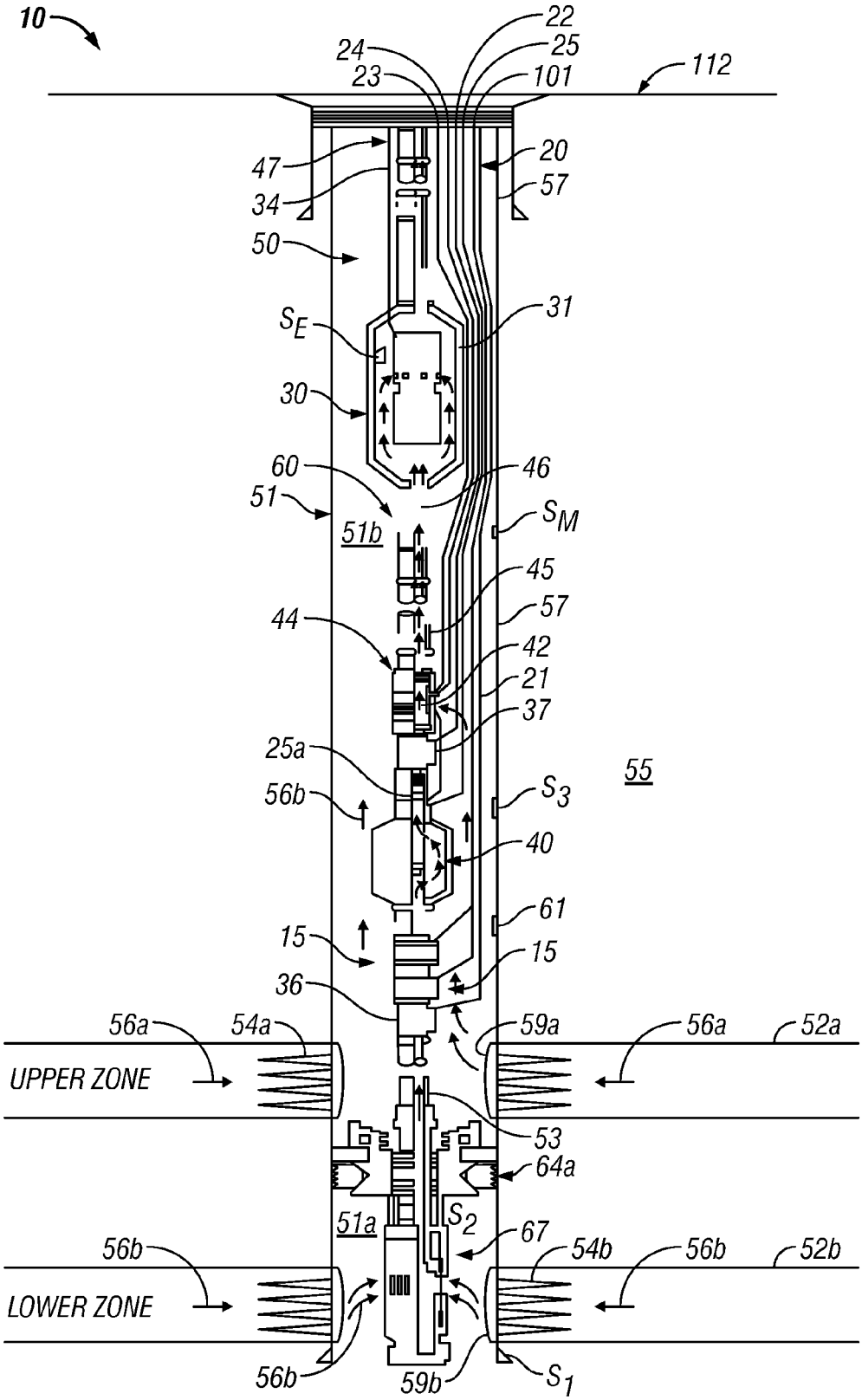
FIGS. 1A and 1B collectively show a schematic diagram of a production well system for producing fluid from multiple production zones according to one possible embodiment.
Figure 1B:
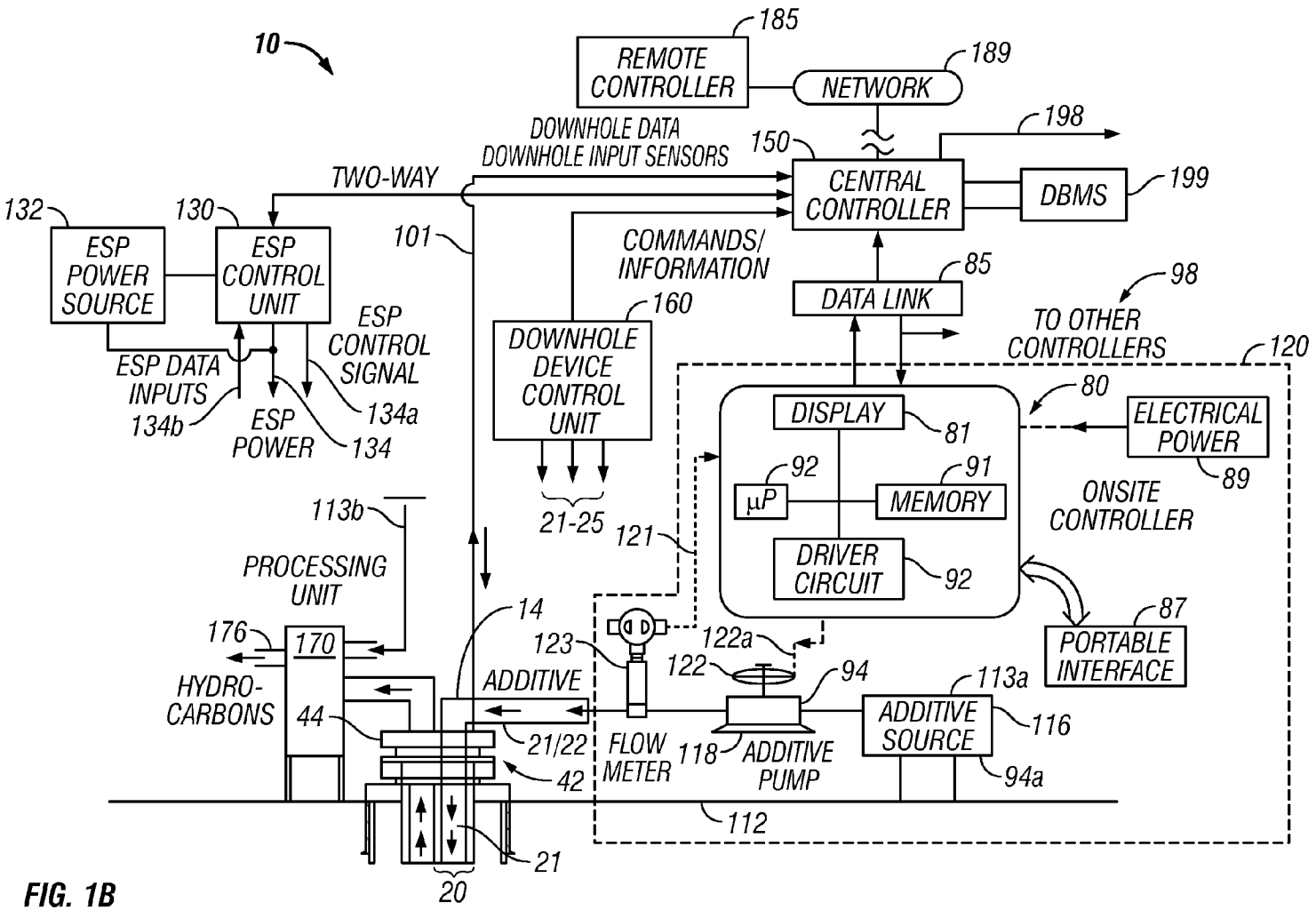

FIGS. 1A and 1B collectively show a schematic diagram of a production well system 10 according to one embodiment of the disclosure. FIG. 1A shows a production well 50 that is configured using exemplary equipment, devices and sensors that may be utilized to implement the concepts and methods described herein. FIG. 1B shows exemplary surface equipment, devices, sensors, controllers, computer programs, models and algorithms that may be utilized to monitor and maintain the health of the equipment in the well and take actions that may provide enhanced production from the well over the life of the well 50. In one aspect, the system 10 is configured to periodically or continuously utilize measurements from various sensors and other data to determine the condition of the various equipment in the system 10, including, but not limited to, the conditions of chokes, valves, ESP, sand screens, casing, cement bond, and tubing. In another aspect, the system 10 may estimate or predict the flow rate changes due to one or more changes in the health of one or more devices. In another aspect, the system 10 may determine the actions that may be taken to reduce, prevent or minimize further deterioration of the equipment.

In another aspect, the system 10 may be configured to determine the desired actions that may be taken to enhance, optimize or maximize production from the well 50 based on the conditions of the downhole and surface equipment that meet selected criteria. In one aspect, the system may use a nodal analysis, neural network or other algorithms to determine the desired actions that will enhance production or provide a higher net present value for the well. In another aspect, system 10 may be configured to send desired messages and alarms to an operator and/or to other locations relating to the condition of the well and the adjustments to be made or actions to be taken relating to the various operations of the well 50 to do one or more of the following: operate the ESP within selected bounds; adjust one or more parameters to enhance, optimize or maximize the production of hydrocarbons from the well, based on the interaction of various wellbore parameters; mitigate or eliminate negative effects of the potential or actual occurrence of a detrimental condition, such as build up of a chemical, such as scale, corrosion, hydrate and asphaltene; predict the failure of a particular equipment, such as casing, cement bond, valve or choke and terminate production from one or more affected zones prior to the occurrence of the failure of the particular equipment, etc. In another aspect, the system may compute net present value based on the current operation of the well and the production after taking one or more actions described herein.

In another aspect, system 10 may be configured to monitor actions taken (if any) by the operator in response to the messages sent by the system; update any actions to be taken after any adjustments have been made by the operator; make selected adjustments when the operator fails to take certain actions; automatically control and monitor any one or more of the devices or equipment in the system 10; and provide status reports to the operator and other locations, including one or more remote locations. In another aspect, the system 10 may be configured to establish a two-way communication with one or more remote locations and/or controllers via one or more suitable data communication links, including the Internet, wired or wireless links and using one or more suitable protocols, including the Internet protocols.

FIG. 1A shows a well 50 formed in a formation 55 that produces formation fluids 56*a* and 56*b* from two exemplary production zones 52*a* (upper production zone) and 52*b* (lower production zone) respectively. The well 50 is shown lined with a casing 57 that has perforations 54*a* adjacent the upper production zone 52*a* and perforations 54*b* adjacent the lower production zone 52*b*. A packer 64*a*, which may be a retrievable packer, positioned above or uphole of the lower production zone perforations 54*a* isolates the lower production zone 52*b* from the upper production zone 52*a*. A screen 59*b* adjacent the perforations 54*b* the well 50 may be installed to prevent or inhibit solids, such as sand, from entering into the wellbore from the lower production zone 54*b*. Similarly, a screen 59*a* may be used adjacent the upper production zone perforations 59*a* to prevent or inhibit solids from entering into the well 50 from the upper production zone 52*a*.

The formation fluid 56*b* from the lower production zone 52*b* enters the annulus 51*a* of the well 50 through the perforations 54*a* and into a tubing 53 via a flow control valve 67. The flow control valve 67 may be a remotely controlled sliding sleeve valve or any other suitable valve or choke that can regulate the flow of the fluid from the annulus 51*a* into the production tubing 53. An adjustable choke 40 in the tubing 53 may be used to regulate the fluid flow from the lower production zone 52*b* to the surface 112. The formation fluid 56*a* from the upper production zone 52*a* enters the annulus 51*b* (the annulus portion above the packer 64*a*) via perforations 54*a*. The formation fluid 56*a* enters production tubing or line 45 via inlets 42. An adjustable valve or choke 44 associated with the line 45 regulates the fluid flow into the line 45 and may be used to adjust flow of the fluid to the surface 112. Each valve, choke and other such device in the well may be operated electrically, hydraulically, mechanically and/or pneumatically from the surface. The fluid from the upper production zone 52*a* and the lower production zone 52*b* enter the line 46.

In cases where the formation pressure is not sufficient to push the fluid 56*a* and/or fluid 56*b* to the surface, an artificial lift mechanism, such as an electrical submersible pump (ESP) or a gas lift system may be utilized to lift the fluids from the well to the surface 112. In the system 10, an ESP 30 in a manifold 31 is shown as the artificial lift mechanism, which receives the formation fluids 56*a* and 56*b* and pumps such fluids via tubing 47 to the surface 112. A cable 34 provides power to the ESP 30 from a surface power source 132 (FIG. 1B) that is controlled by an ESP control unit 130. The cable 134 also may include two-way data communication links 134*a* and 134*b*, which may include one or more electrical conductors or fiber optic links to provide a two-way signals and data link between the ESP 30, ESP sensors $S_E$ and the ESP control unit 130. The ESP control unit 130, in one aspect, controls the operation of the ESP 30. The ESP control unit 130 may be a computer-based system that may include a processor, such as a microprocessor, memory and programs useful for analyzing and controlling the operations of the ESP 30. In one aspect, the controller 130 receives signals from sensors $S_E$ (FIG. 1A) relating to the actual pump frequency, flow rate through the ESP, fluid pressure and temperature associated with the ESP 30 and may receive measurements or information relating to certain chemical properties, such as corrosion, scaling, asphaltenes, etc. and response thereto or other determinations control the operation of the ESP 30. In one aspect, the ESP control unit 130 may be configured to alter the ESP pump speed by sending control signals 134*a* in response to the data received via link 134*b* or instructions received from another controller. The ESP control unit 130 may also shut down power to the ESP via the power line 134. In another aspect, ESP control unit 130 may provide the ESP related data and information (frequency, temperature, pressure, chemical sensor information, etc.) to the central controller 150, which in turn may provide control or command signals to the ESP control unit 130 to effect selected operations of the ESP 30.

A variety of hydraulic, electrical and data communication lines (collectively designated by numeral 20 (FIG. 1A) are run inside the well 50 to operate the various devices in the well 50 and to obtain measurements and other data from the various sensors in the well 50. As an example, a tubing 21 may supply or inject a particular chemical from the surface into the fluid 56*b* via a mandrel 36. Similarly, a tubing 22 may supply or inject a particular chemical to the fluid 56*a* in the production tubing via a mandrel 37. Lines 23 and 24 may operate the chokes 40 and 42 and may be used to operate any other device, such as the valve 67. Line 25 may provide electrical power to certain devices downhole from a suitable surface power source. Two-way data communication links between sensors and/or their associated electronic circuits (generally denoted by numeral 25*a* and located at any one or more suitable downhole locations) may be established by any desired method including but not limited to via wires, optical fibers, acoustic telemetry using a fluid line; electromagnetic telemetry etc.

In one aspect, a variety of other sensors are placed at suitable locations in the well 50 to provide measurements or information relating to a number of downhole parameters of interest. In one aspect, one or more gauge or sensor carriers, such as a carrier 15, may be placed in the production tubing to house any number of suitable sensors. The carrier 15 may include one or more temperature sensors, pressure sensors, flow measurement sensors, resistivity sensors, sensors that provide information about density, viscosity, water content or water cut, and chemical sensors that provide information about scale, corrosion, asphaltenes, hydrates etc. Density sensors may be fluid density measurements for fluid from each production zone and that of the combined fluid from two or more production zones. The resistivity sensor or another suitable sensor may provide measurements relating to the water content or the water cut of the fluid mixture received from each production zones. Other sensors may be used to estimate the oil/water ratio and gas/oil ratio for each production zone and for the combined fluid. The temperature, pressure and flow sensors provide measurements for the pressure, temperature and flow rate of the fluid in the line 53. Additional gauge carriers may be used to obtain pressure, temperature and flow measurements, water content relating to the formation fluid received from the upper production zone 52*a*. Additional downhole sensors may be used at other desired locations to provide measurements relating to chemical characteristics of the downhole fluid, such as paraffins, hydrates, sulfides, scale, asphaltene, emulsion, etc. Additionally, sensors $S_l$-$S_m$ may be permanently installed in the wellbore 50 to provide acoustic or seismic or microseismic measurements, formation pressure and temperature measurements, resistivity measurements and measurements relating to the properties of the casing 51 and formation 55. Such sensors may be installed in the casing 57 or between the casing 57 and the formation 55. Additionally, the screen 59*a* and/or screen 59*b* may be coated with tracers that are released due to the presence of water, which tracers may be detected at the surface or downhole to determine or predict the occurrence of water breakthrough. Sensors also may be provided at the surface, such as a sensor for measuring the water content in the received fluid, total flow rate for the received fluid, fluid pressure at the wellhead, temperature, etc. Other devices may be used to estimate the production of sand for each zone.

In general, sufficient sensors may be suitably placed in the well 50 to obtain measurements relating to each desired parameter of interest. Such sensors may include, but are not limited to: sensors for measuring pressures corresponding to each production zone, pressure along a selected length of the wellbore, pressure inside a pipe carrying the formation fluid, pressure in the annulus; sensors for measuring temperatures at selected places along the wellbore; sensors for measuring fluid flow rates corresponding to each of the production zones, total flow rate, flow through the ESP; sensors for measuring ESP temperature and pressure; chemical sensors for providing signals corresponding to build up of chemical, such as hydrates, corrosion, scale and asphaltene; acoustic or seismic sensors that measure signals generated at the surface or in offset wells and signals due to the fluid travel from injection wells or due to a fracturing operation; optical sensors for measuring chemical compositions and other parameters; sensors for measuring various characteristics of the formations surrounding the well, such as resistivity, porosity, permeability, fluid density etc. The sensors may be installed in the tubing in the well or in any device or may be permanently installed in the well, for example, in the wellbore casing, in the wellbore wall or between the casing and the wall. The sensors may be of any suitable type, including electrical sensors, mechanical sensors, piezoelectric sensors, fiber optic sensors, optical sensors, etc. The signals from the downhole sensors may be partially or fully processed downhole (such as by a microprocessor and associated electronic circuitry that is in signal or data communication with the downhole sensors and devices) and then communicated to the surface controller 150 via a signal/data link, such as link 101. The signals from downhole sensors may also be sent directly to the controller 150.

Referring back to FIG. 1B, the system 10 is further shown to include a chemical injection unit 120 at the surface for supplying additives 113*a* into the well 50 and additives 113*b* to the surface fluid treatment unit 170. The desired additives 113*a* from a source 116 (such as a storage tank) thereof may be injected into the wellbore 50 via injection lines 21 and 22 by a suitable pump 118, such as a positive displacement pump. The additives 113*a* flow through the lines 21 and 22 and discharge into the mandrels 36 and 37. The same or different injection lines may be used to supply additives to different production zones. Separate injection lines, such as lines 21 and 22, allow independent injection of different additives at different well depths. In such a case, different additive sources and pumps are employed to store and to pump the desired additives. Additives may also be injected into a surface pipeline, such as line 176 or the surface treatment and processing facility such as unit 170.

A suitable flow meter 123, which may be a high-precision, low-flow, flow meter (such as gear-type meter or a nutating meter), measures the flow rate through lines 21 and 22, and provides signals representative of the corresponding flow rates. The pump 118 is operated by a suitable device 122, such as a motor or a compressed air device. The pump stroke and/or the pump speed may be controlled by the controller 80 via a driver circuit 92 and control line 122*a*. The controller 80 may control the pump 118 by utilizing programs stored in a memory 91 associated with the controller 80 and/or instructions provided to the controller 80 from the central controller or processor 150 or a remote controller 185. The central controller 150 communicates with the controller 80 via a suitable two-way link 85 that may be a wired, optical fiber or wireless connection and using any one or more suitable protocols. The controller 80 may include a processor 92, resident memory 91, for storing programs, tables, data and models.

The processor 92, utilizing signals from the flow measuring device received via line 121 and programs stored in the memory 91 determines the flow rate of each of the additives and displays such flow rates on the display 81. A sensor 94 may provide information about one or more parameters of the pump, such as the pump speed, stroke length, etc. For example, the pump speed or stroke length may be increased when the measured amount of the additive injected is less than the desired amount and decreased when the injected amount is greater than the desired amount. The controller 80 also includes circuits and programs, generally designated by numeral 92, to provide interface with the onsite display 81 and to perform other desired functions. A level sensor 94*a* provides information about the remaining contents of the source 116. Alternatively, central controller 150 may send commands to controller 80 relating to the additive injection or may perform the functions of the controller 80. While FIGS. 1A-1B illustrate one production well, it should be understood that an oil field can include a plurality of production wells and also a variety of wells, such as offset wells, injection wells, test wells, etc. The tools and devices shown in the figures may be utilized in any number of such wells and can be configured to work cooperatively or independently.

Figure 2:
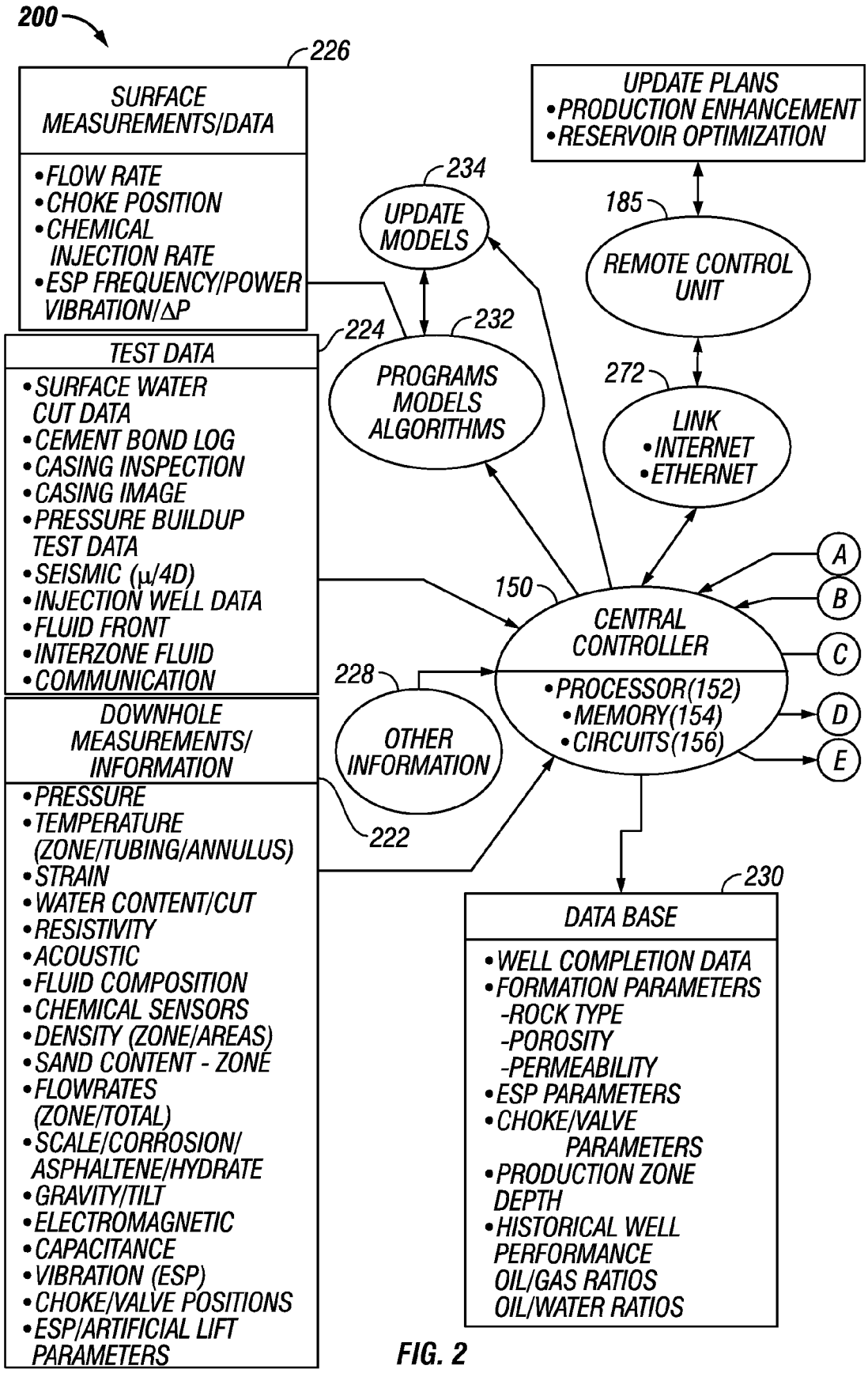
FIG. 2 is an exemplary functional diagram of a control system that may be utilized for a well system, including the system shown in FIGS. 1A and 1B, to take various measurements relating to the well, determine desired actions that may be taken to improve production from the well, automatically take one or more such actions, predict the effects of such actions and monitor the well performance after taking such actions.
Figure 2:
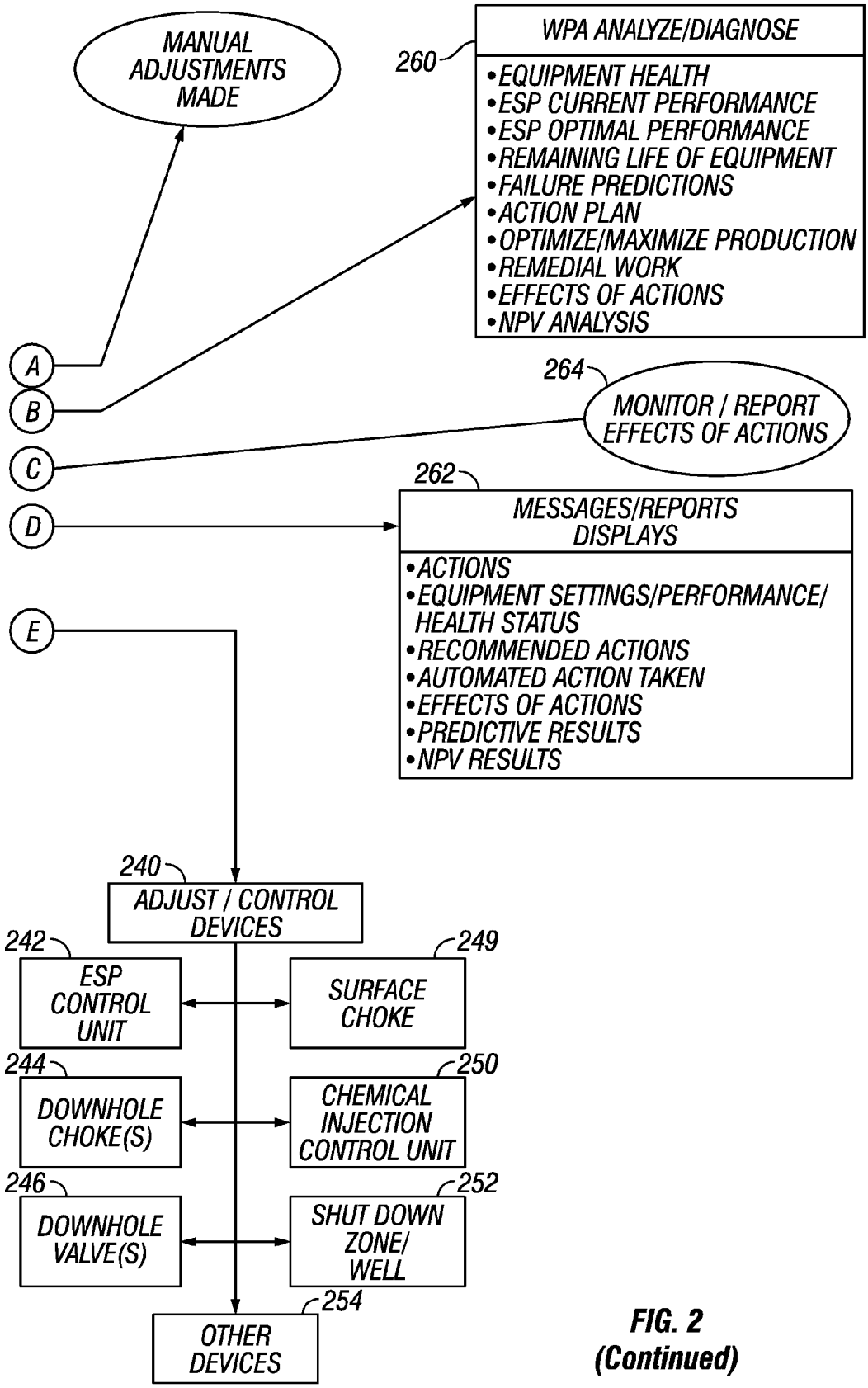
Figure 3:
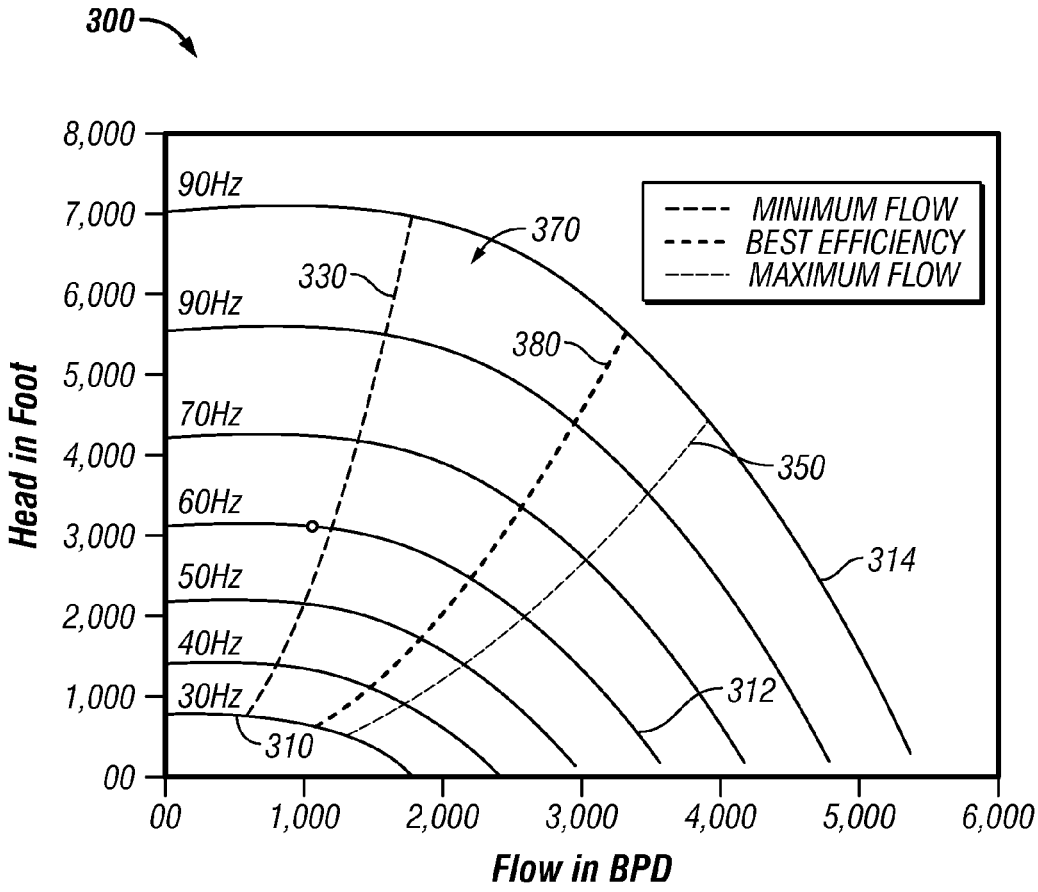
FIG. 3 shows an exemplary two-dimensional operating envelope for an electrical submersible pump that may be utilized in performing one or more methods described herein.

FIG. 2 shows a functional diagram of an exemplary production well system 200 that may be utilized to monitor the health of various devices in the system 10 (FIGS. 1A and 1B) and in response thereto control the operation of one or more devices in the system 10 so as to increase the life or one or more devices in the system and/or enhance, optimize, or maximize production from the well and/or the reservoir. System 200 includes a central control unit or controller 150 that includes one or more processors, such as a processor 152, suitable memory devices 154 and associated circuitry 156 that are configured to perform various functions and methods described herein. The system 200 includes a database 230 stored in a suitable computer-readable medium that is accessible to the processors 152. The database 230 may include: (i) well completion data and information, such as types and locations of sensors in the well, sensor parameters, types of devices and their parameters, such as choke type and sizes, choke positions, valve type and sizes, valve positions, casing wall thickness, etc.; (ii) formation parameters, such as rock type for various formation layers, porosity, permeability, mobility, resistivity, and depth of each formation layer and production zone; (iii) sand screen parameters; (iv) tracer information; (v) ESP parameters, such as horsepower, frequency range, operating pressure range, maximum pressure differential across the ESP, operating temperature range, and an operating envelope, such as envelope 370 as shown in FIG. 3; (vi) historical well performance data, including production rates over time for each production zone, pressure and temperature values over time for each production zone; (vii) current and prior choke and valve settings; (viii) intervention and remedial work information; (ix) sand and water content corresponding to each production zone over time; (x) initial seismic data (two or three dimensional maps) and updated seismic data (four D seismic maps); (xi) waterfront monitoring data; (xii) microseismic data that may relate to seismic activity due to fluid front movement, fracturing, etc.; (xii) casing inspection logs, such as obtained by using acoustic or electrical logging tools that provide an image of the casing showing pits, gauges, holes, cracks in the casing; and (xiii) any other data that may be useful for determining the health of the downhole devices, determining the desired actions and for monitoring the effects of taking the actions so as to recover the hydrocarbons at an enhanced or optimized rate from the well 50.

During the life of a well, one or more tests, collectively designated by numeral 224, are typically performed to estimate the health of various well elements and various parameters of the production zones and the formation layers surrounding the well. Such tests may include, but are not limited to: casing inspection tests using electrical or acoustic logs for determining the condition of the casing and formation properties; well shut-in tests that may include pressure build-up or pressure transients, temperature and flow tests; seismic tests that may use a source at the surface and seismic sensors in the well to determine water front and bed boundary conditions; microseismic measurement responsive to a downhole operation, such as a fracturing operation or a water injection operation; fluid front monitoring tests; secondary recovery tests, etc. All such test data 224 may be stored in a memory and provided to the processor 152 for monitoring the production from well 50, performing analysis relating to determining the health of the various equipment and for enhancing, optimizing or maximizing production from the well 50 and the reservoir.

Additionally, the processor 152 of system 200 may periodically or continually access the downhole sensor measurement data 222, surface measurement data 226 and any other desired information or measurements 228. The downhole sensor measurements 222 includes, but are not limited to: information relating to water content or water cut; resistivity; density; viscosity; sand content; flow rates; pressure; temperature; chemical characteristics or compositions of fluids, including the presence, amount and location of corrosion, scale, paraffin, hydrate and asphaltene; gravity; inclination; electrical and electromagnetic measurements; oil/gas and oil/water ratios; and choke and valve positions. The surface measurements 226 include, but are not limited to: flow rates: pressures: choke and valve positions; ESP parameters; water content determined at the surface; chemical injection rates and locations; tracer detection information, etc.

The system 200 also includes programs, models and algorithms 232 embedded in one or more computer-readable media that are accessible to the processor 152 to execute instructions contained in the programs. The processor 152 may utilize one or more programs, models and algorithms to perform the various functions and methods described herein. In one aspect, the programs/models/algorithms 232 may be in the form of a well performance analyzer (WPA) that is used by the processor 152 to analyze some or all of the measurement data 222, 226, test data 224, information in the database 230 and any other desired information made available to the processor to estimate or predict one or more parameters of the well operation.

The condition of a well can change due to a variety of factors, such as: a zone starts to produce undesirable amounts of water and/or sand; presence of chemicals, such as scale, corrosion, paraffin, hydrate and asphaltene; deterioration of the casing, such as presence of pits, cracks and gauges; breakdown of downhole equipment, including sand screen, downhole valves, chokes, ESP and other equipment; clogging of pipes in the well, etc. Excessive sand production can damage and/or clog sand screens, chokes, valves, and ESP and can clog pipes that carry the fluid to the surface. Changes in the downhole conditions, such as pressure, temperature and flow rates, water cut, etc. can accelerate the formation of scale, corrosion, hydrate, paraffin and asphaltene, each of which can affect the downhole devices. Some of these changes may affect more than one device in the well. For example, corrosion may affect several metallic devices, scale may make moving a valve or choke position difficult; asphaltene may affect the operation of the pipes and ESP, increase in water content or excessive pressure drop between the formation and the well may cause asphaltene to flocculate, which in turn may affect the operation of several other devices; cracks in cement bond may allow water from other formations to penetrate into perforations and then into the well, which in turn may increase the water-cut to undesirable level, which may start to cause the other problems noted above. Therefore in many situations, a change in one or more parameters may necessitate taking one or more actions to mitigate the potential effects of such change. Also, it is desirable to predict or estimate when and the extent of changes and take actions to reduce or eliminate the detrimental affects of such a potential change, which will result in enhanced production of hydrocarbons from the well.

In one aspect, the system 200 using the WPA 260 may be configured to provide a closed-loop system for monitoring the health of the equipment and providing solutions that will tend to enhance, optimize or maximize production from the well as described in more detail below.

Referring to FIGS. 2 and 3, the system 200, in one aspect, may determine one or more parameters indicative of the health and/or operating environment of the ESP and take actions that may increase the life of the ESP and/or operate it more effectively. Each ESP has operating specification and it is generally recommended that the ESP be operated within its specification limits. The system 200, in one aspect, may be configured to operate the ESP within an operating envelope 370 or substantially close to the maximum flow curve 350 shown in FIG. 3. FIG. 3 shows a plot 300 of the relationship of the flow rate or throughput (in barrels per day or "BPD") and the head (in foot) corresponding to various frequencies (speeds) of an exemplary ESP installed in a well, such as well 50. The flow rate is shown along the horizontal axis, while the head is shown along the vertical axis. Each solid curve is a plot of the flow rate versus head corresponding to a particular operating frequency of the ESP. For example, curve 310 corresponds to the frequency of 30 Hz, curve 312 corresponds to 60 Hz and curve 314 corresponds to 90 Hz. Dotted line 330 shows the minimum flow rate as a function of frequency and head at which the ESP should be operated, which may be based on the operating specifications of the ESP or other criterion. Similarly line 350 corresponds to the maximum desired flow rate from the ESP. Thus, the envelope 370 bounded by the curves 310, 314, 330 and 350 defines an operating envelope for the ESP. Curve 380 correspond to the best or optimal operation of the ESP, which may be determined using any desired method or may be set arbitrarily based on the know behavior of the ESPs. In one aspect, the system, as described in more detail later, attempts to operate the ESP in the envelope 370 and may attempt to operate substantially close to line 380.

As noted above, various downhole conditions alone or in combination can affect the ESP health and operation. The controller 150 periodically or substantially continuously monitors the downhole sensors to determine various parameters of the ESP, including temperature in or proximate the ESP, absolute pressure at the ESP, differential pressure across the ESP, flow rate through the ESP, power supplied to the ESP and its corresponding frequency. In addition, the controller 150 may utilize any of the above described information, such as information relating to sand production, particle size of solids in the fluid, water cut, presence and extent of chemicals, such as scale, corrosion, paraffin, hydrate and asphaltene to determine their effect on the ESP and may take actions in response such determination.

For example, models used by WPA may provide that sand being produced and/or the particle size thereof warrants altering or reducing flow rate from a particular zone, altering power to the ESP, etc. In another aspect, WPA may suggest changing flow rate through ESP when the temperature and/or pressures relating to the ESP does not meet a selected or set criterion, such as the temperature or pressure is too high. In another aspect, WPA may suggest to alter the amount or type chemicals being injected when the system detects that undesired chemicals exceed certain limits or that water cut is above a selected limit so as to prevent or reduce the likelihood of a detrimental affect on the ESP. In another aspect, WPA may predict the impact on the ESP of a single or combination of parameters and suggest corresponding actions. In another aspect, WPA may suggest cleaning the ESP, such as by flushing, in response to the presence of sand, corrosion, scale, hydrate, paraffin or asphaltene or injecting chemicals to the ESP.

In one aspect, WPA may utilize models, algorithms that use multiple input parameters and provide a set of actions, which actions when executed will provide extended life of the ESP and enhanced production form the well. WPA may use an iterative method, perform a nodal analysis, utilize a neural network or other algorithms to provide the set of actions. The processor may perform similar functions for other fluid lift mechanisms, such as gas lift mechanisms.

In another aspect, the processor 152 may take one or more actions based on the production of sand. The processor may determine that a particular device, such as a valve or choke has clogged, is clogging at a certain rate or that the sand particle size will damage one or more devices in the well. It may determine the extent to which a particular sand screen has been damaged. The processor using the WPA may suggest to shut in the particular zone, or alter flow from the zone or to flush a choke or valve, etc. The processor also may predict the impact of sand production on one or more devices downhole. Additionally, the processor may utilize the information relating to the ESP described above and suggest a combination of actions, such as altering flow from a choke and that from the ESP in series or substantially simultaneously so as to reduce the sand production, extend the lives of the ESP, choke and/or sand screen, etc.

The controller also may determine the extent of sand and chemicals passing through the ESP. WPA utilizing one or more of these parameters may estimate or predict a physical condition of the ESP and suggest one or more corrective actions. For example if the temperature of the ESP exceeds a selected value, WPA may suggest that the ESP frequency be increased by a certain amount so as to increase the flow of the fluid through the ESP, which in turn will reduce the temperature to an acceptable level. Alternatively, or in addition to, WPA may suggest reducing the flow rate from a selected zone to reduce the inflow of the sand. WPA may suggest altering the ESP operation based on one or more actual, anticipated or predicted changes in the condition of the well.

In another aspect, the processor may take one or more actions based on the presence and extent of certain chemicals in the fluid. In one aspect, the processor may suggest altering the chemical injection rate; altering flow rate from a particular zone by changing the position of a choke or valve; moving the position of the choke or valve one or more than one time to remove scale or corrosion from the choke or valve; increasing production from another zone when changing the choke position is either not feasible or does not produce the desired effect; performing a clean-up, such as flushing, operation, etc.

In another aspect, the processor may estimate the extent of pipe or casing erosion and provide actions to be taken. The measure of erosion may be an extent of corrosion, scale build-up, location and extent of pits, cracks and gouges, etc.

The information about the corrosion, scale, etc. may be provided to or computed by the processor 152. Well log data, such as obtained from electrical or acoustic logs, may be used to provide quantitative estimates of casing erosion and/or images of the casing. The model, based on one or more of the presence, temperature, extent of the chemical, water production, and other parameters provide the suggested actions. In another aspect, the processor, for example using one or more of the chemical build-up rate, the well log information, water front location and/or other data may predict or extrapolate the condition of the any device over time, including that of the casing and cement bond, and in response thereto provide suggested actions that will tend to: increase the life of the equipment and/or provide enhanced production of hydrocarbons from the well. The actions may be a combination of actions that may include altering a chemical injection rate, performing a clean-up operation, altering a choke or valve position, altering speed of the ESP, altering flow through another artificial lift mechanism, closing in a zone and/or changing production from another zone, etc.

In another aspect, the processor may determine actions from the condition of the cement bond between the casing and the formation. Cement bond logs (typically acoustic logs) provide logs that can show the location and extent to cracks in the cement bond. The processor using the WPA may extrapolate or predict from the current cement bond log information, the historic information stored in the data base, microseismic measurements, and/or four dimensional seismic the cement bond condition over a time period and its impact on the production of fluids from the well and determine the suggested actions.

Thus in one aspect, the processor using the WPA utilizes multiple inputs and may use a nodal analysis or neural networks or other algorithms to provide corrective actions that will extend the life of one or more devices in the well and provide enhanced production of hydrocarbons from the well. WPA, in addition to determining the health of the devices, may estimate the remaining life of the equipment, predict the production rate over time from the well, suggest remedial work, such as flushing, fracturing, workover, etc.

As described above, the processor sends messages to the operator to take the desired actions, sends such information to the remote controller 185 and displays the desired data for use by the operator. The processor continues to monitor the effects of the actions taken by the operator. Once the operator makes a change, the central controller 150 continues to monitor the various parameters and determines whether the effects of the changes made correspond to the expected results. The controller continues to monitor the health of the various devices, the various parameters and the flow from the various zones. In the case of an ESP, the controller monitors the specific operation point in the envelope 370, and may continue to cause changes to maintain the ESP operation within the envelope 370 or close to the curve 380, as the case may be. The controller, however, may determine that in order to achieve enhanced or optimal production, it may be more desirable to operate ESP in a particular sub-region, of the envelope 370, which may or may not include the maximum flow line 380, while increasing or decreasing production from one or more zones.

In another aspect, the controller, using the WPA estimates the expected production rate from the well based on the changes suggest or made and performs a net present value analysis to determine the economic impact of the changes. In one aspect, the controller uses multiple parameters for the model and determines the settings for the various devices that will extend the life of the equipment and/or enhanced production from the well. The inputs may be any combinations of parameters, which are selected from the parameters relating to the health of one or more downhole devices, actual operating parameters of the various devices, such as the frequency of ESP, current settings of the chokes, valve, sand production, water cut presence and extent of chemicals, chemical injection rates, downhole temperature and pressure at one or more locations, and other desired parameters. WPA also may use surface measurements or results computed from the surface measurements, downhole measurements or results computed from the downhole measurements, test data, information from the database and any other information that may be pertinent to a particular well and uses a nodal analysis and/or another forward looking models to obtain the new settings. The nodal analysis may include prediction of the effects of the new settings on the production and iterate this process until a combination of new settings (final plan) is determined that will extend the life of equipment and/or enhance, optimize or maximize the production form the particular well.

Referring back to FIG. 2 ,the central controller may be configured to automatically initiate one or more of the recommended actions, for example, by sending command signals to the selected device controllers, such as to ESP controller to adjust the operation of the ESP 242; control units or actuators (160, FIG. 1A and element 240) that control downhole chokes 244, downhole valves 246; surface chokes 249, chemical injection control unit 250; other devices 254, etc. Such actions may be taken in real time or near real time. The central controller 150 continues to monitor the effects of the actions taken 264. In another aspect, the central controller 150 or the remote controller 185 may be configured to update one or more models/algorithms/programs 234 for further use in the monitoring of the well. Thus, the system 200 may operate in a closed-loop form to monitor the performance of the well, take or cause to take desired actions, and continue to monitor the effects of such actions.

While the foregoing disclosure is directed to the certain exemplary embodiments and methods, various modifications will be apparent to those skilled in the art. It is intended that all such modifications within the scope of the appended claims be embraced by the foregoing disclosure. Also, the abstract is provided to meet certain statutory requirements and is not be used to limit the scope of the claims.

What is claimed is:

1. A method for producing fluid from a well, comprising:

determining a first setting of a first device using a processor wherein the first device is under use for producing the fluid from the well at a first flow rate;

selecting a set of parameters using the processor, wherein the set of parameters includes a parameter relating to health of a second device and a plurality of parameters selected from a group comprising flow rate, pressure, temperature, presence of a selected chemical, water content, sand content, and chemical injection rate;

determining a second setting for the first device using the processor, wherein the second setting that provides an increased life of the second device and a second flow rate for the fluid from the well relative to the first flow rate using the selected set of parameters as an input to a computer model, wherein the second setting is determined after the first setting; and storing the determined second setting on a suitable medium.

2. The method of claim 1 further comprising (i) operating the well corresponding to the second setting of the first device, and (ii) determining a performance of the well based on the determined setting.

3. The method of claim 2 further comprising:

predicting an occurrence of one of: water breakthrough, cross-flow condition, breakdown of a device installed in the well; and determining the second setting based on such prediction.

4. The method of claim 2, wherein the second setting comprises at least one of: altering the chemical injection rate; altering an operation of an electrical submersible pump; shutting in a selected production zone; altering position of a choke; altering position of a valve; and altering flow through an artificial lift mechanism.

5. The method of claim 2 further comprising sending a message relating to the second setting to at least one of: an operator; and a remote location from the well.

6. The method of claim 2 further comprising using the processor that automatically sets the at least one first device to the second setting.

7. The method of claim 1, wherein the parameter relating to the health of the second device relates to at least one of: an electrical submersible pump; a valve; a choke; a casing lining the well; a pipe carrying the fluid from the well toward the surface; and a sand screen.

8. The method of claim 1 further comprising:

estimating the second flow rate from the well over an extended time period based on the second setting; and estimating a net present value for the well corresponding to the estimated second flow rate for the extended time period.

9. The method of claim 1, wherein the group further comprises information relating to: resistivity; density of the fluid; fluid composition; a capacitance measurement relating to the fluid; vibration; acoustic measurements in the well; differential pressure across a device in the well; oil-water ratio; and gas-oil ratio.

10. The method of claim 1, wherein the group further comprises: microseismic measurements; pressure transient test measurements; well log measurements; a measurement relating to presence of one of scale, hydrate, corrosion, paraffin, and asphaltene.

11. A computer-readable medium that has embedded therein a computer program that is accessible to a processor for executing instructions contained in the computer program, the computer program comprising:

instructions to determine a first setting of a first device while in use for producing a fluid from a well at a first flow rate;

instructions to select a first set of input parameters that includes a parameter relating to health of a second device and a plurality of parameters selected from a group comprising information relating to flow rate, pressure, temperature, presence of a selected chemical, water content, sand content, and chemical injection rate;

instructions to determine a second setting for the first device that provides at least one of an increased life of the at least one second device and a second flow rate for the fluid from the well relative to the first flow rate using the selected set of parameters, wherein the second setting is determined after the first setting; and instructions to store the determined second setting on a suitable medium.

12. The computer-readable medium of claim 11 wherein the computer program further comprises:

instructions to send signals to operate the well corresponding to the second setting of the first device; and instructions to estimate a performance of the well based on the second setting.

13. The computer-readable medium of claim 11, wherein the parameter relating to the health of the second device relates to at least one of: an electrical submersible pump; a valve; a choke; a casing lining the well; a pipe carrying the fluid from the well toward the surface; and a sand screen.

14. The computer-readable medium of claim 11, wherein the computer program further comprises:

instructions to estimate the second flow rate from the well over an extended time period based on the second setting; and instructions to estimate a net present value for the well corresponding to the estimated second flow rate for the extended time period.

* * * * *